US006361678B1

(12) United States Patent
Childs et al.

(10) Patent No.: US 6,361,678 B1
(45) Date of Patent: Mar. 26, 2002

(54) METHOD OF DETECTING A SHORT INCIDENT DURING ELECTROCHEMICAL PROCESSING AND A SYSTEM THEREFOR

(75) Inventors: William V. Childs, Stillwater; Christopher L. Gross, Woodbury; Mark P. Smith, White Bear Lake, all of MN (US); Eric A. Schotz, Decatur, AL (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/643,626

(22) Filed: Aug. 22, 2000

(51) Int. Cl.[7] ..... C25B 15/02

(52) U.S. Cl. ..... 205/335; 205/336; 204/222; 204/223; 204/230.4; 204/261; 204/273

(58) Field of Search ..... 204/230.4, 243.1, 204/247.1, 261, 273, 278, 222, 223; 205/335, 336; 324/76.13, 512, 513, 520, 527, 537, 555, 753

(56) References Cited

U.S. PATENT DOCUMENTS

| | | | | |
|---|---|---|---|---|
| 1,666,581 A | | 4/1928 | Rainaud | |
| 2,519,983 A | | 8/1950 | Simons | |
| 3,753,976 A | | 8/1973 | Grass, Jr. et al. | 260/233.3 A |
| 3,957,596 A | | 5/1976 | Seto | 204/275 |
| 4,088,556 A | * | 5/1978 | Pellegri et al. | 204/222 |
| 4,139,447 A | | 2/1979 | Faron et al. | 204/244 |
| 4,203,821 A | | 5/1980 | Cramer et al. | 204/268 |
| 4,406,768 A | | 9/1983 | King | 204/268 |
| 4,950,370 A | | 8/1990 | Tarancon | 204/255 |
| 5,174,878 A | | 12/1992 | Wullenweber et al. | 204/254 |
| 5,322,597 A | | 6/1994 | Childs et al. | 204/268 |

FOREIGN PATENT DOCUMENTS

JP 2-30785 1/1990

OTHER PUBLICATIONS

Journal of the Electrochemical Society, D.E. Danley, "Development and Commercialization of the Monsanto Electrochemical Adiponitrile Process", Oct. 1984, pp. 435C—442C.

"Organic Electrochemistry", Third Edition, 1991, H. Lund, M.M. Baizer, Marcel Dekker, Inc., New York, NY, pp. 1283—1336 .No Month Available.

Advances in Flourine Chemistry, "The Electrochemical Process for the Synthesis of Fluoro–Organic Compounds" J. Burdon and J.C. Tatlow, vol. 1, pp 129–37, 1960, No month available.

"Organic Electrochemistry", Third Edition, 1991, H. Lund, M.M. Baizer, Marcel Dekker, Inc., New York, NY, pp 1103–12, No month available.

"Industrial Electrochemical Processes", A.J. Rudge, pp 71–75, 1967, Marcel Dekker, Inc., New York. No month available.

Topics Curr. Chem., "Electrofluorination of Organic Compounds" F.G. Drakesmith, vol. 193, pp. 197, 1997. No month available.

"Emerging Opportunities for Electroorganic Processes", D.E. Danly, pp. 132–36, 1984, Marcel Dekker, Inc., New York. No month available.

* cited by examiner

*Primary Examiner*—Bruce F. Bell
(74) *Attorney, Agent, or Firm*—Lisa M. Fagan

(57) ABSTRACT

The present invention provides a method of detecting a short incident in an electrochemical cell (e.g., a Simons electrochemical fluorination cell or bipolar flow cell) using means for detecting vibration to detect vibration of an external piece on the cell. The present invention further provides a system for detecting a short incident in an electrochemical cell.

24 Claims, 7 Drawing Sheets

METHOD OF DETECTING A SHORT INCIDENT DURING ELECTROCHEMICAL PROCESSING AND A SYSTEM THEREFOR

FIELD OF THE INVENTION

This invention relates to a method for detecting a short incident during electrochemical processing and a system therefor.

BACKGROUND OF THE INVENTION

One industrial process for producing fluorochemical compounds is the electrochemical fluorination process commercialized initially in the 1950s by Minnesota Mining and Manufacturing Company which comprises passing a direct electric current through an electrolyte, (i.e., a mixture of fluorinatable organic starting compound, liquid anhydrous hydrogen fluoride, and perhaps a conductivity additive), to produce the desired fluorinated compound or fluorochemical. This process is commonly referred to as the "Simons electrochemical fluorination process" or "Simons ECF". Simons ECF cells typically utilize a monopolar electrode assembly, i.e., electrodes connected in parallel through electrode posts to a source of direct current at a low voltage (e.g., four to eight volts). Simons ECF cells are generally undivided, single-compartment cells, i.e., the cells typically do not contain anode or cathode compartments separated by a membrane or diaphragm. The Simons ECF process is disclosed in U.S. Pat. No. 2,519,983 (Simons) and is also described in some detail by J. Burdon and J. C. Tatlow in *Advances in Fluorine Chemistry* (M. Stacey, J. C. Tatlow, and A. G. Sharpe, editors) Volume 1, pages 129–37, Buttersworths Scientific Publications, London (1960); by W. V. Childs, L. Christensen, F. W. Klink, and C. F. Kolpin in *Organic Electrochemistry* (H. Lund and M. M. Baizer, editors), Third Edition, pages 1103–12, Marcel Dekker, Inc., New York (1991); by A. J. Rudge in *Industrial Electrochemical Processes* (A. T. Kuhn, editor), pages 71–75, Marcel Dekker, Inc., New York (1967); and by F. G. Drakesmith, *Topics Curr. Chem.*, 193, 197, (1997).

Various modifications and/or improvements have been introduced to the Simons ECF process since the 1950s including, but not limited to, those described in U.S. Pat. No. 3,753,976 (Voss et al.); U.S. Pat. No. 3,957,596 (Seto); U.S. Pat. No. 4,203,821 (Cramer et al.); U.S. Pat. No. 4,406,768 (King); Japanese Patent Application No. 2-30785 (Tokuyama Soda KK); SU 1,666,581 (Gribel et al.); U.S. Pat. No. 4,139,447 (Faron et al.); and U.S. Pat. No. 4,950,370 (Tarancon).

U.S. Pat. No. 5,322,597 (Childs et al.) more recently describes the practice in a bipolar flow cell of an electrochemical fluorination process comprising passing by forced convection a liquid mixture comprising anhydrous hydrogen fluoride and fluorinatable organic compound at a temperature and a pressure at which a substantially continuous liquid phase is maintained between the electrodes of a bipolar electrode stack. The bipolar electrode stack comprises a plurality of substantially parallel, spaced-apart electrodes made of an electrically-conductive material, e.g., nickel, which is essentially inert to anhydrous hydrogen fluoride and which, when used as an anode, is active for electrochemical fluorination. The electrodes of the stack are arranged in either a series or a series-parallel electrical configuration. The bipolar electrode stack has an applied voltage difference which produces a direct current which can cause the production of fluorinated organic compound.

Another example of a bipolar flow cell is the Solutia EHD (electrohydrodimerization) cell. See *J. Electrochem. Soc.*: REVIEWS AND NEWS, D. E. Danly, 131(10), 435C–42C (1984) and *Emerging Opportunities for Electroorganic Processes*, D. E. Danly, pages 132–36, Marcel Dekker, Inc., New York (1984).

Yet another electrochemical cell is an electrolyzer such as those described by Wullenweber et al. in U.S. Pat. No. 5,174,878. Wullenweber et al. disclose an electrolyzer having bipolar cells arranged in a row and consisting each of two metallic partitions, spring-elastic electrodes bearing on the partitions, and a diaphragm which is disposed between the electrodes and spaced from the electrodes by spacers.

Although electrochemical processing is an effective method to manufacture chemicals, for example fluorochemicals, on occasion the electrochemical cell(s) may experience a "short incident". A "short incident" is defined herein as an event such as for example, a run-away chemical reaction, unstable two-phase flow, or plate flexing which ultimately may lead to a connection of comparatively low resistance made between points on a circuit between which the resistance is normally much greater than zero. The ultimate cause of serious damage from a short incident is current flow through plate-to-plate contacts and the deposition of sufficient energy at those contacts to melt the electrode (e.g., a metal plate, such as nickel). A short incident can result in considerable damage to the electrochemical cell which often means lost time during manufacturing and expense to repair the cell. Thus, it is desirable to eliminate such short incidents or to the extent possible to reduce damage caused by these short incidents. Detecting a short incident as soon as possible helps to reduce damage to the cell caused by the short incident and in turn helps to minimize lost time during manufacturing. Detecting short incidents before plate-to-plate contact occurs substantially lessens damage.

One method of detecting a short incident is to use a mechanics stethoscope, a device much like the familiar physician's stethoscope, but which uses a pointed solid rod instead of the familiar bell for making contact with the body being examined. With the Simons ECF cell or with low voltage conventional cells, a mechanics stethoscope can be used to detect vibration in the audible frequencies. However, with a bipolar flow cell where the voltage is possibly higher, perhaps several hundred volts, a mechanics stethoscope should not be used for safety reasons. Further, the ability to detect a short incident using a mechanics stethoscope varies with the user's ability and thus may at times not be reliable, and it is not practical.

Another method of detecting a short incident is to use a large plastic-handled screwdriver in the same manner as a mechanics stethoscope.

These methods require an operator's attention, are not reliable, and may take a long time to detect the onset of a short incident. Damage to the cell pack and lost production time is often considerable before a short incident is confirmed and a cell is taken out of service.

Another method of detecting a short incident is to monitor current and voltage responses. If the current is set, the voltage fluctuates. However, the "noise" in the voltage can be relatively large as compared to the fluctuation in the voltage due to an individual short incident (for example a 2 to 3 volt drop out of 500 to 600 volts). Thus, it is often difficult, if not impossible to detect a problem until several plates in a cell are affected. It may be possible to monitor voltages between individual plates or set of plates. However, this may be difficult to engineer, may lead to leaks in the system, and involves more data collection, storage, etc.

Thus, the need exists for a method of detecting a short incident in an electrochemical cell which is safe for lower voltage electrochemical cells and for higher voltage electrochemical cells; is reliable; and preferably is inexpensive.

SUMMARY OF THE INVENTION

The present invention provides a method for detecting a short incident in an electrochemical cell. The method of the present invention advantageously detects a short incident soon after initiation and thus limits damage, is safe for both low and high voltage electrochemical cells, and is reliable. Further, the method of the present invention is inexpensive to install and to operate.

The method of the present invention utilizes a means for detecting vibration (e.g., an accelerometer) of sufficient sensitivity to detect movement of an externally-located piece of the cell system.

The method of the present invention is a method of detecting a short incident in an electrochemical cell comprising the steps of:

(a) providing an electrochemical cell system having a cell pack and a coupling device, said coupling device being in connection with said cell pack, wherein during electrochemical cell system operation, said coupling device vibrates;

(b) providing a means for detecting vibration of said coupling device, said means for detecting vibration being rigidly affixed to said coupling device;

(c) providing a means for analyzing and monitoring vibration of said coupling device, said means for analyzing and monitoring being connected to said means for detecting vibration;

(d) operating said electrochemical cell system causing said coupling device to vibrate;

(e) detecting said vibration using said means for detecting vibration;

(f) allowing said means for detecting vibration to send a signal to said means for analyzing and monitoring vibration;

(g) continuously measuring, analyzing, and monitoring said vibration to establish a normal baseline amplitude envelope;

(h) operating said electrochemical cell system until said means for analyzing and monitoring vibration measures an amplitude excursion outside of said normal baseline amplitude envelope;

(i) sending a signal to an indicator; and (j) discontinuing operation of said electrochemical cell.

In one aspect of the present invention the coupling device is a bus bar, the means for detecting vibration is an accelerometer, and the means for analyzing and monitoring vibration is an analog-to-digital converter to a computer.

Another aspect of the present invention is a system for detecting a short incident in an electrochemical cell where the system comprises:

(a) an electrochemical cell system comprising an electrochemical cell pack;

(b) a coupling device being in connection with the cell pack;

(c) a means for detecting vibration rigidly affixed to said coupling device;

(d) a means for analyzing and monitoring vibration of said coupling device connected to said means for detecting vibration; and (e) an indicator;

wherein said coupling device vibrates during electrochemical cell system operation, said means for detecting vibration detects said vibration and transmits a signal to said means for analyzing and monitoring vibration to establish a normal baseline amplitude envelope, and wherein when a short incident occurs the signal amplitude exceeds the normal baseline amplitude envelope which triggers said indicator and said electrochemical cell operation is discontinued.

The electrochemical cell of the present invention can be a conventional Simons ECF cell, a bipolar flow cell, an electrolyzer such as that described in U.S. Pat. No. 5,174,878, or other electrolytic cells and devices.

These figures are not to scale and are intended to be merely illustrative and non-limiting.

DETAILED DESCRIPTION OF ILLUSTRATIVE EMBODIMENTS

The present invention relates to a method of detecting a short incident in an electrochemical cell. Advantageously, the method of the present invention allows a short incident to be detected soon after the initiating event which limits the amount of damage to the cell and thus reduces downtime of the manufacturing facility, risk of injury, and the amount of money spent repairing the electrochemical cell pack. Further, the method of the present invention is reliable, safe, clean, and non-intrusive. When compared to other known short detection methods, the method of the present invention may reduce the repair costs by 90%.

The present invention also comprises a system for detecting a short incident in an electrochemical cell.

Method

The present invention provides a method of detecting a short incident in an electrochemical cell. Generally, this method involves using a means for detecting vibration to detect vibration (e.g., in and out motion or movement) of a coupling device. During normal system operation (i.e., no short incident is occurring), this vibration is converted to a normal baseline amplitude envelope by a means for analyzing and monitoring vibration. Envelope is defined herein as a lower and upper signal limit, an upper signal limit, or a lower signal limit. When a vibration is detected such that the amplitude exceeds the normal baseline amplitude envelope an indicator is triggered which may automatically discontinue operation of the electrochemical cell, or may call the excursion out of the normal baseline amplitude envelope to the attention of the operator for operator action. Typically, an indicator is triggered when the amplitude excursion exceeds the normal baseline amplitude envelope by an amount specified by an operator (e.g., by 400%, preferably by 200%). Alternatively, the indicator may be triggered when a set of conditions is met. For example, a certain number of spikes in amplitude over a given time may be an "amplitude excursion". An amplitude excursion is defined herein as a set of conditions which triggers an alarm.

Electrochemical Cell System

The method of the present invention can be used to detect a short incident with conventional electrochemical cells, such as a Simons ECF cell, with bipolar flow cells, and electrolyzers.

An electrochemical cell system of the present invention generally comprises the cell or cells, the overhead system (e.g., condensers, heat exchangers, etc.), piping, and pumps. The electrochemical cell generally comprises the cell containment vessel or cell body, the cell lid, and the cell pack.

Figure 1:
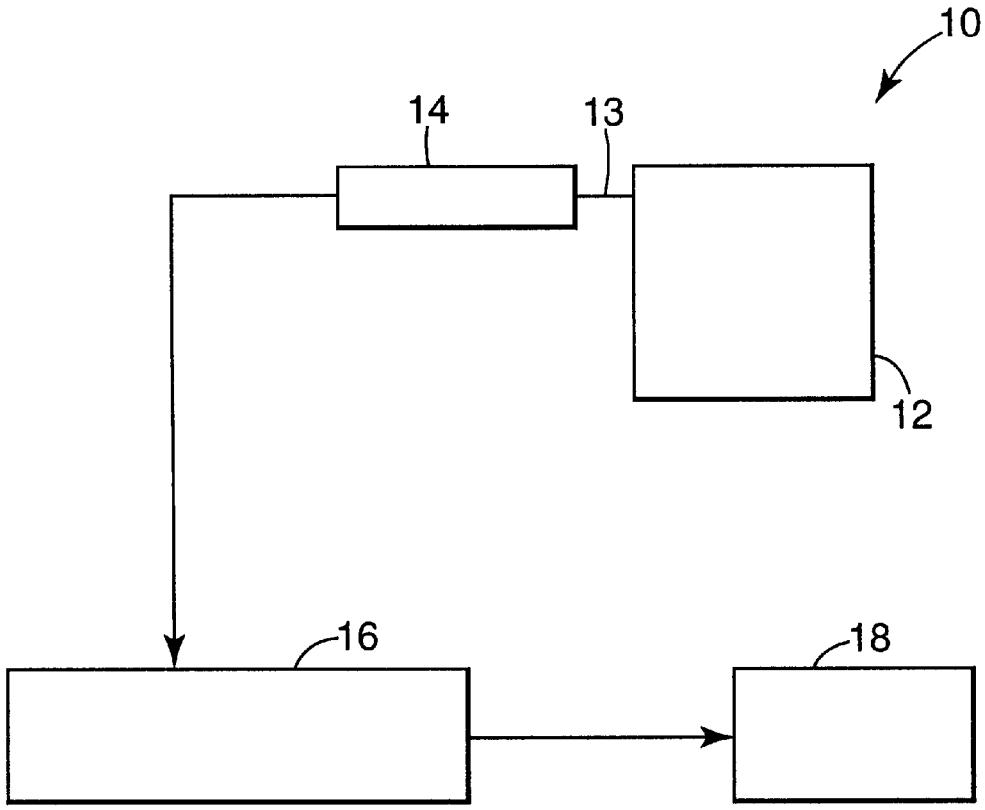
FIG. 1 is a schematic of a short detection system 10 of the present invention where the coupling device 13 is attached to the electrochemical cell 12. A means for detecting vibration 14 is attached to the coupling device 13 and the means for analyzing and monitoring vibration 16 is connected to the means for detecting vibration 14 and indicator 18.
Figure 2:
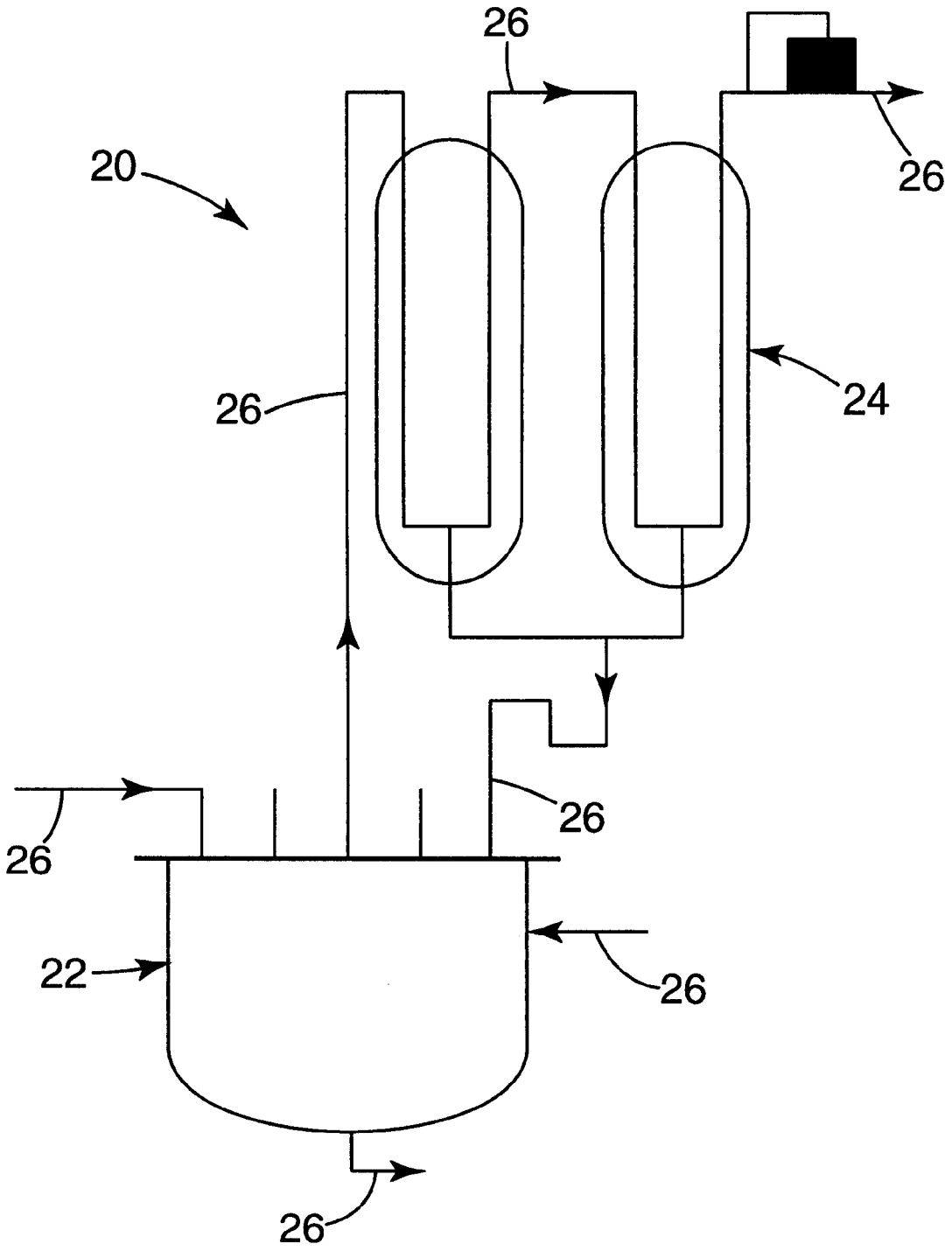
FIG. 2 is a schematic of a conventional ECF cell system or a Simons ECF cell system.

A Simons ECF cell or conventional electrochemical cell is described for example in U.S. Pat. No. 2,519,983 (Simons) incorporated by reference herein. In FIG. 2, the cell system 20 comprises the cell containment vessel 22, the overhead system 24, and piping 26.

Figure 3:
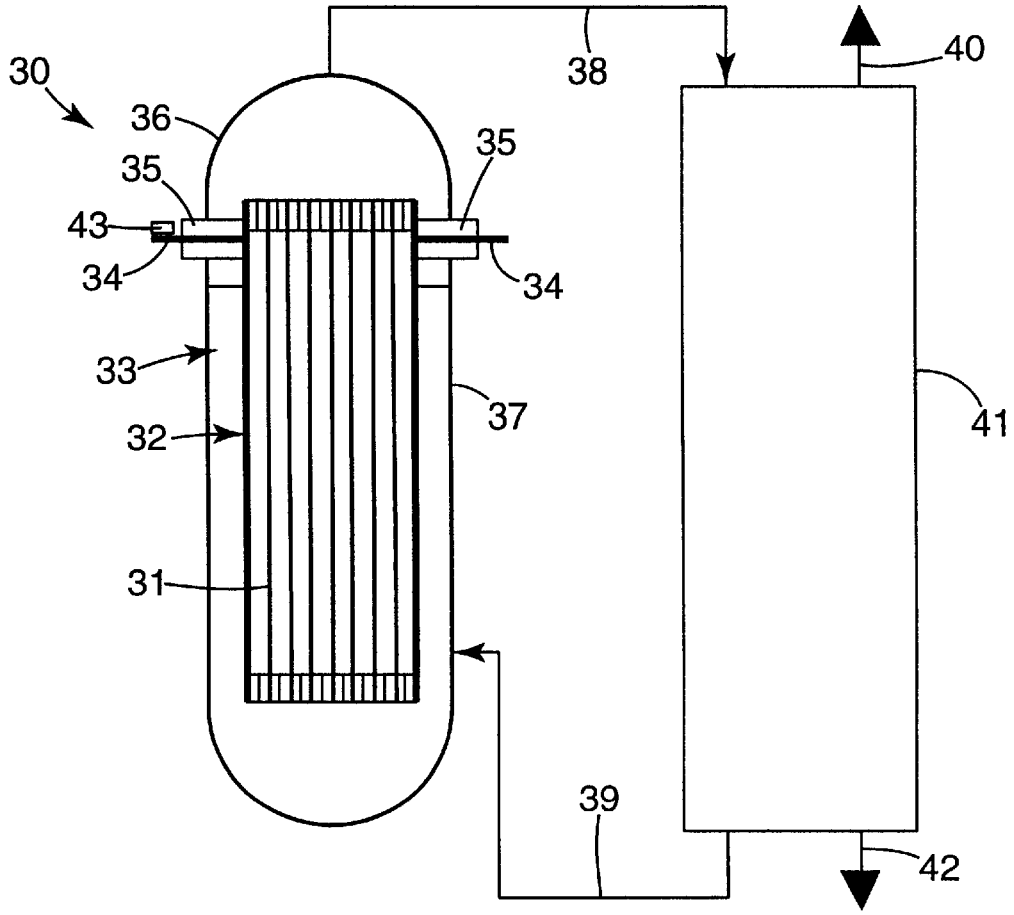
FIG. 3 is a schematic of a bipolar flow cell system.

A bipolar flow electrochemical cell is described for example in U.S. Pat. No. 5,322,597 (Childs et al.) incorporated by reference herein. In FIG. 3, the bipolar flow cell system 30 comprises the cell containment vessel 37, the overhead system 41, and the piping 38, 39, 40, 42. The bipolar electrode plates 31 are nominally one-eighth inch thick nickel. The terminal electrode plates 32 are one-half inch thick nickel.

The bus bars 34 are electrically attached to the terminal electrode plates 32 and are insulated from the electrolyte 33 and penetrate the cell containment vessel 37 through insulating seal glands 35.

The means for detecting vibration 43 may be attached to one of the bus bars 34 which in turn is rigidly affixed to one of the terminal electrode plates. Alternatively it could be similarly affixed to the cell lid 36, the cell containment vessel 37, the exit conduit 38, the inlet conduit 39, or other locations vibrationally connected to the cell pack.

The offgas exit nozzle 40 delivers the hydrogen and various byproduct gases to facilities for further processing and for safe disposal. This will include reduction of the pressure from cell operating pressure to nominally atmospheric pressure.

The overhead systems 41 include: separation of product gases and perfluorinated products from the circulating electrolyte; circulation processes; temperature control; and addition of makeup feed, HF, additives.

The liquid exit nozzle 42 delivers the recovered perfluorinated products to facilities for further processing and storage.

An electrolyzer is described for example by Wullenweber et al. in U.S. Pat. No. 5,174,878 which is incorporated herein by reference.

Coupling Device

The coupling device of the present invention includes, but is not limited to, bus bars, the cell body, the cell lid, or associated electrochemical cell system piping. Generally, the coupling device is a piece on or a part of the cell system which allows the means for detecting vibration to be solidly or directly attached to the cell system. The coupling device is in connection with the cell pack. This connection can be either direct or indirect. Preferably, the coupling device is in direct contact with the pack in the cell and protrudes from the cell containment vessel. The means for detecting vibration may be insulated from the coupling device (e.g., an accelerometer may be attached to a phenolic resin insulator which is attached to a bus bar) to electrically isolate the means for detecting vibration from the coupling device.

The coupling device is generally fixed, but in such a manner as to allow some movement or vibration. Generally, the coupling device vibrates while the electrochemical cell system is operating. During a short incident, this coupling device continues to move or vibrate, but at a higher amplitude of vibration (or experiences a more pronounced movement). Motion may occur to some degree in all three translational and three rotational degrees of freedom during the short incident. This change in vibration, this more pronounced movement, is detected by the means for detecting vibration and results in an excursion outside of the normal baseline amplitude envelope.

Means For Detecting Vibration

The means for detecting vibration can be any transducer capable of measuring displacement, velocity, and/or acceleration via a contact or non-contact means. Examples of contact transducers include, but are not limited to, Linear Variable Displacement Transducer (LVDT), strain gauge, veloci-meter, dial indicator, etc. Some examples of non-contact transducers include, but are not limited to, capacitance gauge, eddy current probe, induction sensor, ultrasonic sensor, fiber optic, and laser interferometer. However, due to the durability, high frequency response, and low cost, accelerometers are preferable.

An accelerometer is a device which responds to the rate of change of position of the coupling device or to the rate of change of position of any body to which it is rigidly affixed. If the accelerometer is a single-axis device, that response is to change of position in only one direction.

The accelerometer of the present invention is typically a piezoelectric quartz crystal which can detect vibration. Piezoelectric accelerometers generally consist of three elements: the transducer body, the piezoelectric sensing element, and the seismic mass. The sensing device is preloaded between the base plate and the seismic mass. The seismic mass is constant and thus the force acting on the measuring element is proportional to the acceleration in accordance with Newton's first law" F=ma. An electric charge is generated which is proportional to the force. This electric charge is sent to the measuring and monitoring device.

A commercially available accelerometer such as the Model 8712A5M1 (sensitivity of 1.0 volts/G with a maximum range of 5Gs) available from Kistler Instrument Corporation Amherst, N.Y., can be used. Generally, the accelerometer has a wide frequency range. Preferably, the surfaces are as flat as possible to allow for proper vibration transmittal and to prevent undesired signal noise attributed from loose mounting. The accelerometer preferably is mounted directly on the coupling device such that it is rigid over the frequency range of interest and able to transfer high frequency vibration to the quartz crystal. The frequency range of interest may vary with the electrochemical cell, but generally a range from about 0.5 hertz to about 5000 hertz is suitable. The method of mounting the accelerometer varies with the accelerometer and the coupling device. For example, mounting pads, studs, wax, magnets, and triaxial cubes may be used to mount or install the accelerometer on the coupling device. However, for frequencies above 100 hertz, mounting studs are preferable.

The means for detecting vibration is connected to the means for analyzing and monitoring vibration. For example, the means for detecting vibration can be connected to the means for analyzing and monitoring vibration via a shielded cable.

The means for detecting vibration transmits a signal to the means for analyzing and monitoring vibration. This signal is used during normal electrochemical cell system operation to establish the normal baseline amplitude envelope. Excursions outside of this normal baseline amplitude envelope are used to diagnose short incidents and the onset of short incidents.

One or more additional means for detecting vibration may be used. These additional means for detecting vibration can be on a coupling device (e.g., the same or different coupling device) or alternatively not on the coupling device.

Additional means for detecting vibration aid in determining the spatial location of the source of vibration.

Means For Analyzing and Monitoring Vibration

The means for analyzing and monitoring vibration is used to establish a normal baseline amplitude envelope. The means for analyzing and monitoring vibration is also used to detect short incidents and the onset of short incidents.

The means for analyzing and monitoring vibration may consist of any device capable of collecting the voltage or current from means for detecting vibration. Although not limited to, this means for analyzing and monitoring vibration can include any data logger, data storage device, DAT tape recorder, oscilloscope, strip chart recorder, data acquisition system, PLC (programmable logic controller), or present on-line process monitoring system.

However, personal computer based data acquisition system is preferable. The advantages for this type of system include:

1) Multi-channel capability.
2) Allows for storage of data for later retrieval and review following a confirmed short incident.
3) Adjustable analog-to-digital sampling rate. A faster sampling rate allows for detection of short incident vibration spikes that may occur in milli-seconds. A slower sampling rate for analyzing and monitoring vibration may miss the short time frame vibration spike from the short incident. This can decrease the advance warning of the beginning short incident.
4) If desired, software can be used to filter the signal.
5) Allows for easy implementation of real-time analysis functions and programmed logic for alarm notification through digital or analog output.
6) Easily customized for user/operator interface.
7) User/operator adjustable means for detecting vibration range (or normal baseline amplitude envelope).
8) Data and computer screen can be viewed from anywhere on internal network.
9) Economical hardware and software.

Preferably, such means is a combination of a power supply coupler, signal conditioner and isolator backplane, analog-to-digital converter data acquisition card, computer, monitor, and cables. Here, the means for detecting vibration transmits a signal to the power supply coupler which is connected to the signal conditioner and isolator backplane via a coaxial cable. The signal conditioner and isolator backplane is used to electrically isolate the high voltage potential that could exist at the transducers with respect to the computer data acquisition system. The signal conditioner and isolator backplane is connected to the analog-to-digital converter data acquisition card (located within the computer slot) via a ribbon cable. The digital output alarm of the analog-to-digital converter card is connected with a cable to the indicator.

In one possible configuration, the means for detecting vibration delivers to an analog-to-digital converter an analog electrical signal reflecting movement of the coupling device. The analog-to-digital converter data acquisition card delivers to a computer a digital representation of the signal to produce a two-dimensional (time and amplitude) array of digital information. This digital information can be used for analysis. For example, frequency domain analysis, statistical analysis, etc. of the data can be used to define the normal baseline amplitude envelope and to identify an amplitude excursion. Optionally, the data may be first filtered to remove "noise" before establishing the normal baseline amplitude envelope. During normal operation, the two-dimensional array is used to establish a normal baseline amplitude envelope. This envelope reflects the normal movement of the coupling device and is equipment dependent. In addition to the normal movement of the coupling device, the array may occasionally show a spike from "noise in the system" that is not due to a short incident. This noise may be an electrical spike from the power system leaking into the cabling or perhaps from vibration due to an outside mechanical source. If unrecognized, these noise spikes can result in false positives. The computer, with its program, processes the array and delivers the results to the indicator.

The computer may have a software program (e.g., LABVIEW™ software version 5.1-National Instruments, Austin, Tex.) which may be used to calculate the minimum and maximum amplitudes of vibration from a block of means for detecting vibration data. In one embodiment, the spread (maximum minus minimum) of the data may be compared to a user defined means for detecting vibration range (i.e., the normal baseline amplitude envelope) to determine if an alarm should be initiated. The normal baseline amplitude envelope may be determined over several hours of normal flow cell operation. Generally, the vibration from normal operations result in a well-defined envelope. This normal baseline amplitude envelope may be unique to each flow cell. When a short incident occurs, the vibration energy deposition from the short incident exceeds the envelope and provides occasional or frequent spikes. If a defined set of conditions is met, the means for analyzing and monitoring vibration (e.g., a computer) transmits an output (e.g., digital or analog) signal to the indicator.

In one embodiment of the present invention, the normal baseline amplitude envelope may be used to establish a set point pair which consists of an upper bound and a lower bound. Signal excursions outside of the set point pair may automatically discontinue operation of the electrochemical cell, or may call the excursion outside of the set point pair to the attention of the operator for operator action. These bounds are necessarily established from experience and are established to detect the onset of essentially all short incidents and at the same time lessening of "false positives" which may result in a cell shutdown and pack tear-down when there is no problem. To lessen the problem of false positives, a certain number, or a certain frequency, or some combination thereof, or excursions outside of the set point pair may be established prior to making a short incident call.

The onset of a short incident may be shown to be a few isolated spikes well outside of the normal baseline amplitude envelope. As the short incident progresses numerous relatively low amplitude spikes broaden the envelope and there are occasional bursts of spikes outside of the set point pair.

Indicator

The indicator of the present invention generally is used to notify an operator of a problem. The indicator may be an alarm which sounds or otherwise delivers an indication during a short incident to prompt an operator to shut down the electrochemical cell system or the indicator itself may automatically shut down the electrochemical cell system.

System

The present invention comprises a system for detecting a short incident in an electrochemical cell. The system comprises:

(a) an electrochemical cell system comprising an electrochemical cell pack;

(b) a coupling device being in connection with the cell pack;

(c) a means for detecting vibration rigidly affixed to said coupling device;

(d) a means for analyzing and monitoring vibration connected to said means for detecting vibration; and (e) an indicator;

wherein said coupling device vibrates during electrochemical cell system operation, said means for detecting vibration detects said vibration and transmits a signal to said means for analyzing and monitoring vibration to establish a normal baseline amplitude envelope and wherein when a short incident occurs, the signal amplitude exceeds the normal baseline amplitude envelope and said indicator is triggered and said electrochemical cell operation is discontinued.

EXAMPLES

The present invention will be further described with reference to the following non-limiting examples and test methods. All parts, percentages, and ratios are by weight unless otherwise specified.

Comparative Example C1

A bipolar flow cell as described above and in FIG. 3, with a tangential feed inlet nozzle was scaled to a plant scale cell with an electrode stack (cell pack) having 89 bipolar plates and two terminal plates, making 90 unit cells. A one-axis accelerometer (Kistler Model No. 8710A5M1, available from Kistler Instrument Corp., Amherst, N.Y.) was attached to a bus bar (electrical connector for the electrode stack) via an electrically insulating rigid phenolic resin block which was in turn attached to the bus bar with a metal bracket. The accelerometer was mounted so that it responded principally to acceleration in the direction of the long dimension of the bus bar. The accelerometer was connected to a power supply coupler (Kistler Model No. 5118A1) which powered the accelerometer and accepted the accelerometer output. The coupler also included a built-in analog 1 kHz low-pass filter (Kistler Model No. 5327A1). The coupler was, in turn, connected to an input module (National Instruments Model 5B41-03, available from National Instruments, Austin, Tex.) within a 16 channel signal conditioner and isolator backplane (National Instruments 5B Series). The backplane also contained modules simultaneously receiving voltage (National Instruments Model 5B41-03) and amperage (National Instruments Model 5B40-03) from the flow cell. The backplane was contained in a wall-mounted industrial enclosure box. Output from the backplane and modules was supplied to an analog-to-digital converter data acquisition card (National Instruments PCI-MIO-16E-4) through a 2 meter shielded cable (National Instruments SH6868). The data acquisition card was placed in the expansion slot of a personal computer (Hewlett Packard Vectra 333 MHz). A customized analyzing and monitoring software program (National Instruments LabView™) was set up to sample and log data at 1442 Hz on each of 8 channels (for monitoring 2 flow cells simultaneously). The analyzing and monitoring program was set up to log to a warning file when the output from bus bar mounted accelerometer exceeded a specified threshold voltage of 0.1 volts (0.1 Gs). The log was not available to the operators during operation of the flow cell.

The flow cell was charged with an electrolyte solution, and circulation of the electrolyte through the flow cell was started. The flow cell was brought to a steady state at 206 kPa, 54° C., and 1.51 kA/m$^2$, and then operated using interrupted current with feed rates of HF, of octanesulfonyl fluoride, and of dimethyl disulfide (in a weight ratio of 2.20/1.00/0.0287) essentially equivalent to that converted by the electrolysis current. During interrupted current operation, the flow cell was operated with the following repeating cycle: held at full current for about 37 seconds, ramped down in one second to zero current delivered by the power supply, held at zero current delivered by the power supply for three seconds, and ramped back up to full current in one second. The cell, operated in parallel with an essentially identical cell, was kept in continuous operation until it was determined by inspection of the cell current, terminal voltage, and peripheral information (standard short incident diagnostic procedure) that a short incident was occurring in the flow cell. Observation of one or more of the following was used as an indication that a short incident was occurring: 1) an imbalance in the currents passing to the cells, 2) a drop in the terminal voltage at constant current, 3) an imbalance in the voltages measured between the terminals and the cell vessel, and 4) information that indicated a short incident when only the suspect cell was in operation. After it was determined, without reference to the warning file log, that a short incident was occurring, the bipolar flow cell was shut down and purged. The electrode stack was then removed and disassembled. Extensive damage was found throughout the electrode stack with 70 plates severely damaged through short incidents that propagated horizontally, causing large holes in several plates.

Later review of the warning file log revealed that the analyzing and monitoring program had logged an alarm 24 minutes before the standard short incident diagnostic procedure was completed.

Comparative Example C2

Comparative Example C1 was essentially repeated using a similarly equipped bipolar flow cell. When the electrode stack was disassembled ten plates were found to be damaged and there was considerable propagation and damage at many places on these plates.

Figure 4:
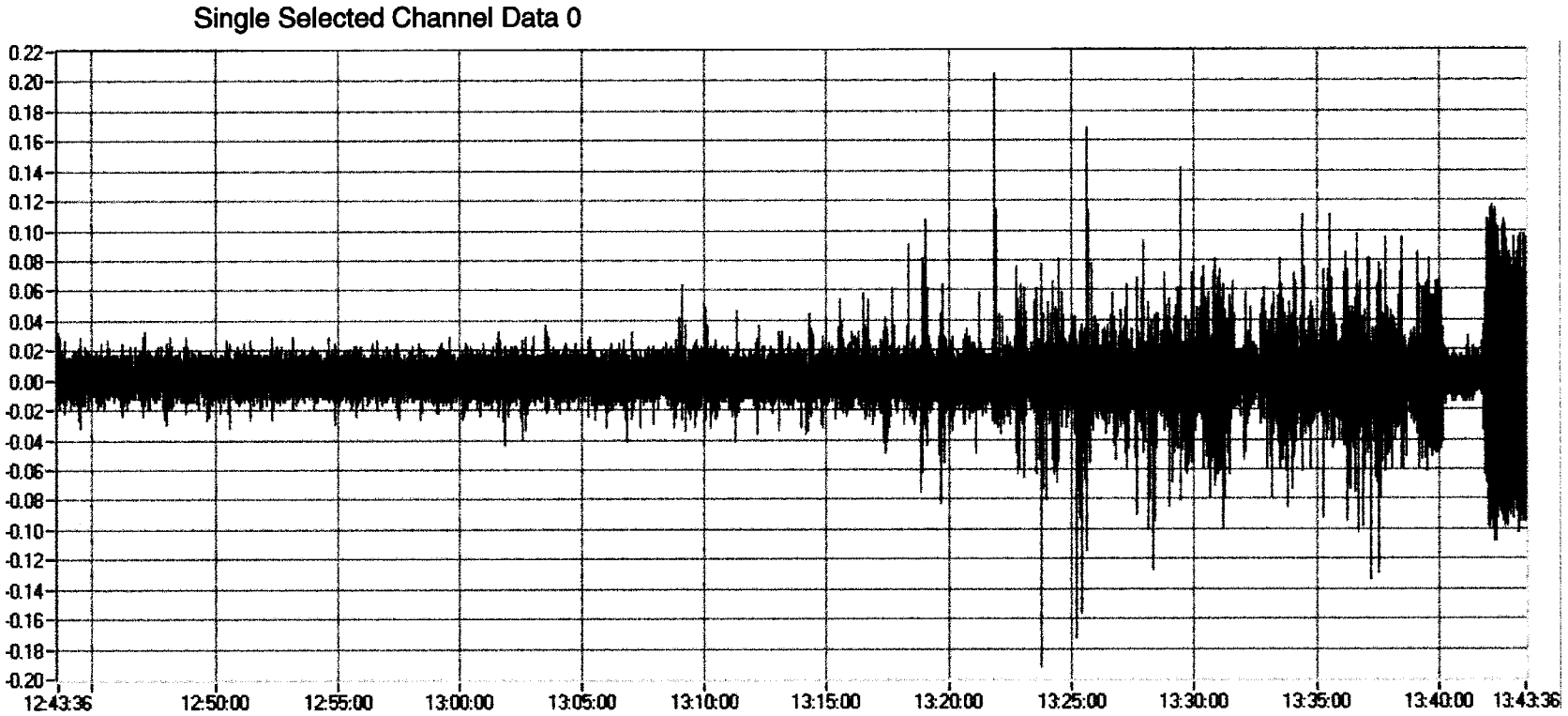
FIG. 4 is a graph of amplitude over time for Comparative Example C2. Every $100^{th}$ data point is plotted over a 60 minute interval.
Figure 5:
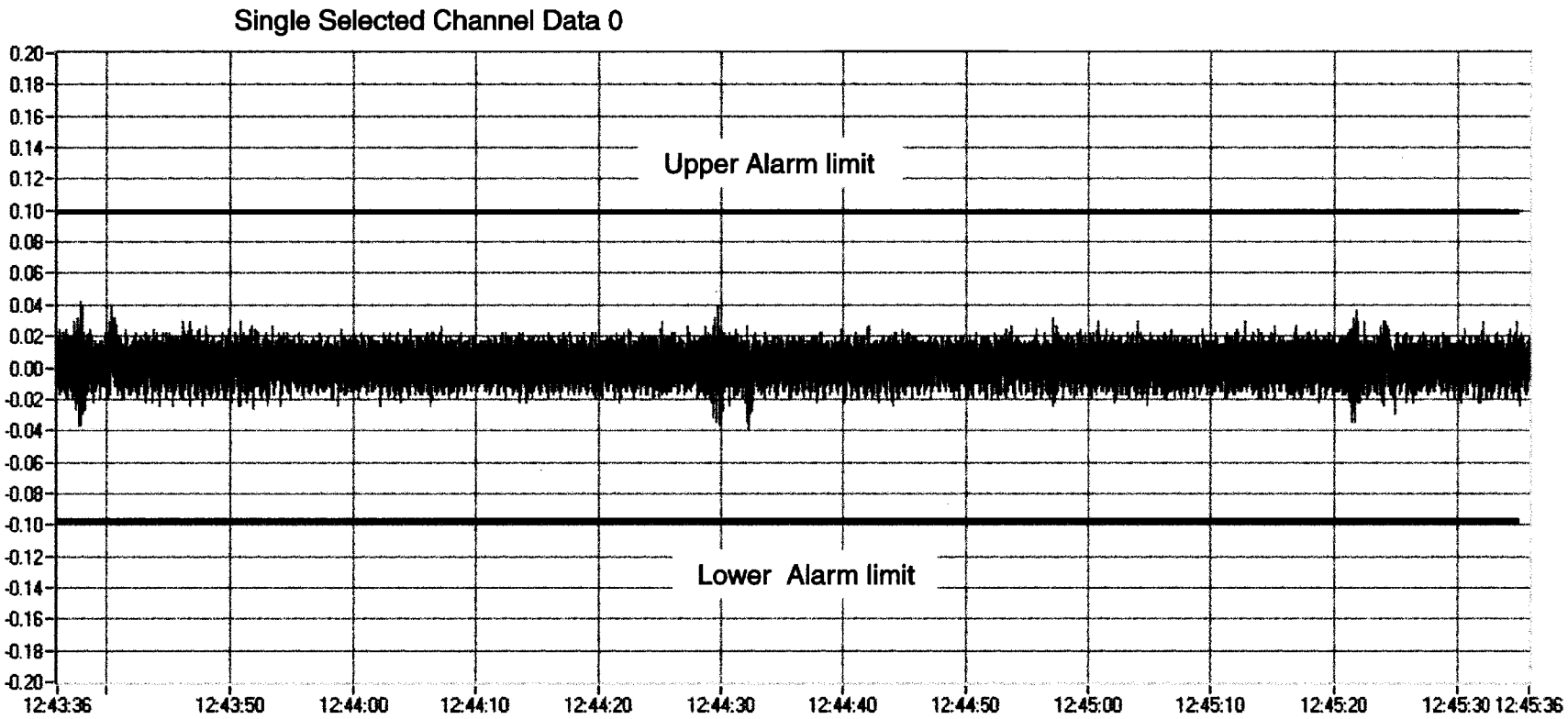
FIG. 5 is a graph of amplitude over time for Comparative Example C2. Every data point sampled is plotted. This 3 minute time interval depicts the normal baseline amplitude envelope. The three regions of larger amplitude are "noise" from the interrupted current and not an amplitude excursion.
Figure 6:
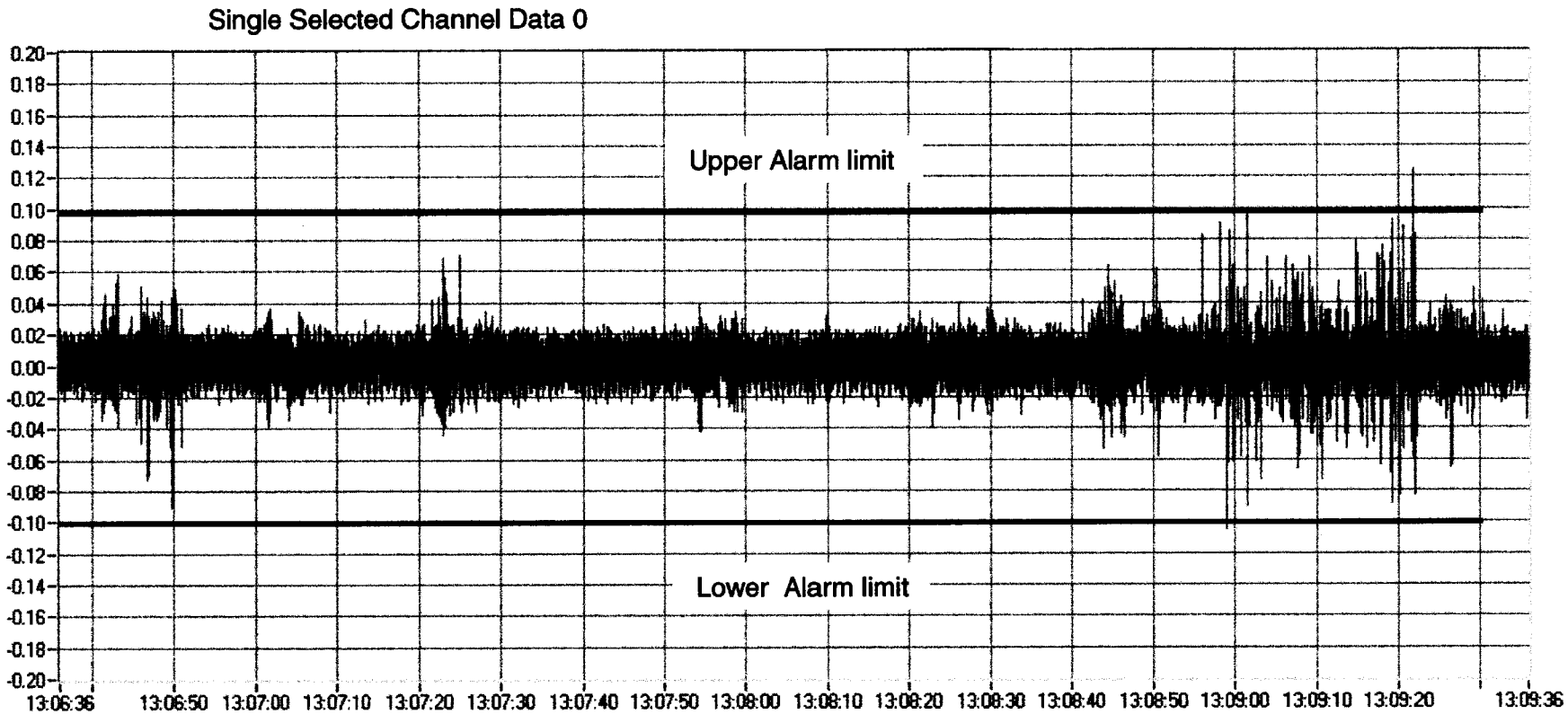
FIG. 6 is a graph of amplitude over time for Comparative Example C2. Every data point sampled is plotted over this 3 minute interval. This graph depicts the first amplitude excursion corresponding to the time when the first alarm was logged.
Figure 7:
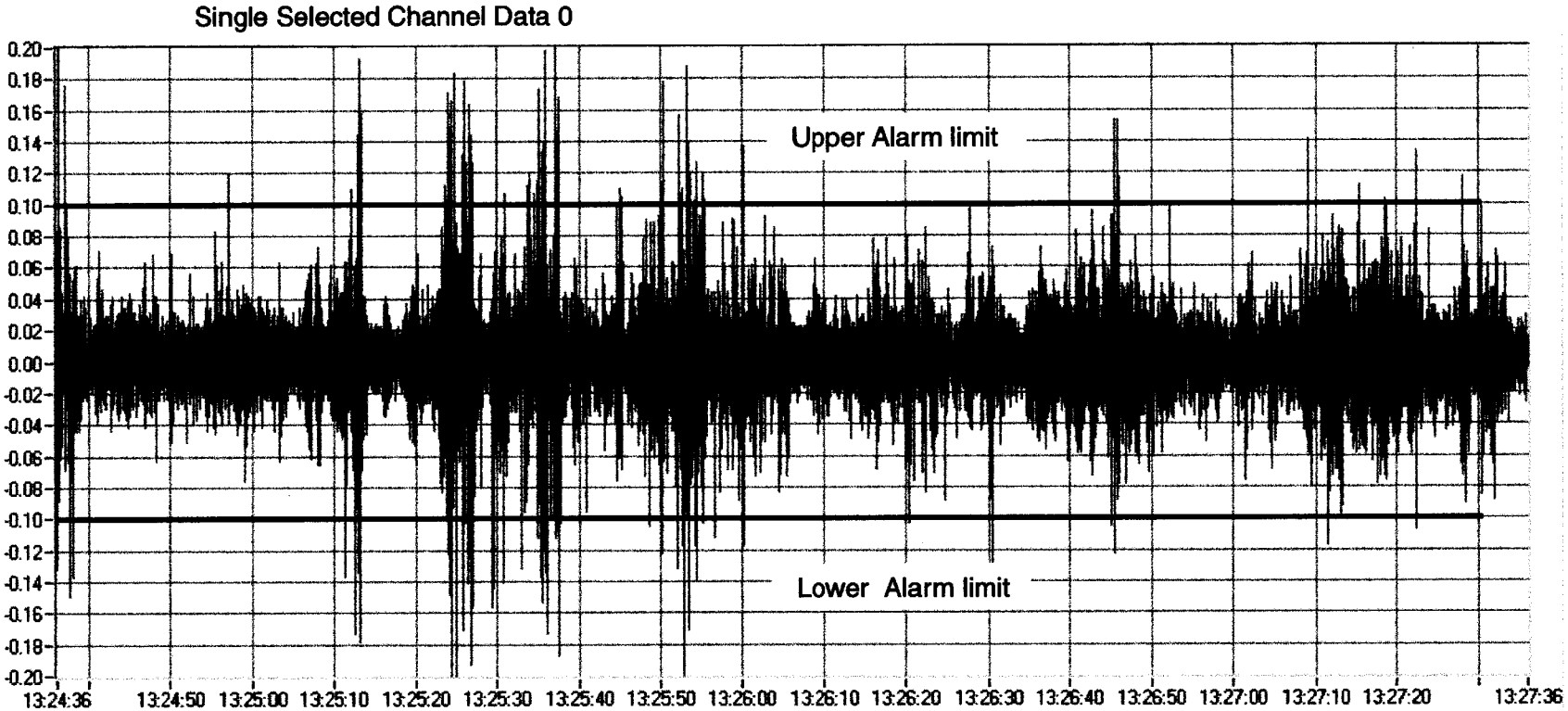
FIG. 7 is a graph of amplitude over time for Comparative Example C2. Every data point is plotted over this 3 minute interval. This graph depicts increasing amplitude and frequency of the excursions with the progressing short incident.

Later review of the warning file log showed that a warning alarm had been logged 31 minutes before the operator determined that a short incident had occurred. FIG. 4 shows that at 13:40, the cell operation was discontinued. FIG. 6 shows that at 13:09, the first amplitude excursion was captured.

Example 1

Comparative Example C1 was essentially repeated using a similar flow cell except that the warning alarms were logged and made available to the operator for observation while the cell was in operation, and the cell was shut down when the analyzing and monitoring program logged and presented a second warning alarm. When the electrode stack was removed from the cell and examined for damage twelve plates were found to be have suffered minimal damage from the short incident. This damage was limited to a small area at the entrance to the electrode stack, and there was no propagation away from this small area.

The results in Example 1 and Comparative Examples C1 and C2 show that the short incident detection system and method of detecting a short incident of the present invention reliably detected the presence of a short incident in an electrochemical cell, and that damage to the electrodes was reduced by shutting the cells down when the short incident detection system warned that a short incident was occurring.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims as set forth herein as follows.

What is claimed is:

1. A method of detecting a short incident in an electrochemical cell comprising the steps of:

(a) providing an electrochemical cell system having an electrochemical cell pack and a coupling device, said coupling device being in connection with said cell pack, wherein during electrochemical cell system operation, said coupling device vibrates;

(b) providing a means for detecting vibration of said coupling device, said means for detecting vibration being rigidly affixed to said coupling device;

(c) providing a means for analyzing and monitoring vibration of said coupling device, said means for analyzing and monitoring vibration being connected to said means for detecting vibration;

(d) operating said electrochemical cell system causing said coupling device to vibrate;

(e) detecting said vibration using said means for detecting vibration;

(f) allowing said means for detecting vibration to send a signal to said means for analyzing and monitoring vibration;

(g) continuously analyzing, measuring, and monitoring said vibration to establish a normal baseline amplitude envelope;

(h) operating said electrochemical cell system until said means for analyzing and monitoring vibration measures an amplitude excursion outside of said normal baseline amplitude envelope;

(i) sending a signal to an indicator; and (j) discontinuing operation of said electrochemical cell.

2. The method of detecting a short incident in an electrochemical cell according to claim 1, wherein said cell is selected from the group consisting of a Simons electrochemical fluorination cell, a bipolar flow cell, and an electrolyzer.

3. The method of detecting a short incident in an electrochemical cell according to claim 1, wherein said coupling device is selected from the group consisting of a bus bar, the cell body, the cell lid, and electrochemical cell system piping.

4. The method of detecting a short incident in an electrochemical cell according to claim 1, wherein said means for detecting vibration is selected from the group consisting of an accelerometer, Linear Variable Displacement Transducer, strain gauge, veloci-meter, dial indicator, capacitance gauge, eddy current probe, induction sensor, ultrasonic sensor, fiber optic, and laser interferometer.

5. The method of detecting a short incident in an electrochemical cell according to claim 4, wherein said accelerometer is a piezoelectric accelerometer.

6. The method of detecting a short incident in an electrochemical cell according to claim 1, wherein said means for detecting vibration detects movement over a frequency range from about 0.5 hertz to about 5000 hertz.

7. The method of detecting a short incident in an electrochemical cell according to claim 1, wherein said means for analyzing and monitoring vibration is selected from the group consisting of a personal computer, data logger, data storage device, DAT tape recorder, oscilloscope, strip chart recorder, data acquisition system, programmable logic controller, and present on-line process monitoring system.

8. The method of detecting a short incident in an electrochemical cell according to claim 7, wherein said personal computer comprises a means for establishing a normal baseline amplitude envelope.

9. The method of detecting a short incident in an electrochemical cell according to claim 1, wherein said means for analyzing and monitoring vibration comprises a personal computer, monitor, signal conditioner and isolator backplane, an analog-to-digital converter data acquisition card, a power supply coupler, and cables.

10. The method of detecting a short incident in an electrochemical cell according to claim 1, wherein said means for analyzing and monitoring vibration is connected to said means for detecting vibration via a coaxial cable.

11. The method of detecting a short incident in an electrochemical cell according to claim 1, wherein the amplitude excursion exceeds the normal baseline amplitude envelope by at least 200%.

12. The method of detecting a short incident in an electrochemical cell according to claim 1, further comprising the step of providing one or more additional means for detecting vibration, said additional means for detecting vibration being located not on said coupling device, wherein said additional means identifies vibrations outside of said cell pack.

13. A system for detecting a short incident in an electrochemical cell comprising:

(a) an electrochemical cell system comprising an electrochemical cell pack;

(b) a coupling device being in connection with the cell pack;

(c) a means for detecting vibration rigidly affixed to said coupling device;

(d) a means for analyzing and monitoring vibration connected to said means for detecting vibration; and (e) an indicator;

wherein said coupling device vibrates during electrochemical cell system operation, said means for detecting vibration detects said vibration and transmits a signal to said means for analyzing and monitoring vibration to establish a normal baseline amplitude envelope and wherein when a short incident occurs, the signal amplitude exceeds the normal baseline amplitude envelope and said indicator is triggered and said electrochemical cell operation is discontinued.

14. The system for detecting a short incident in an electrochemical cell according to claim 13, wherein said cell is selected from the group consisting of a Simons electrochemical fluorination cell, a bipolar flow cell, and an electrolyzer.

15. The system for detecting a short incident in an electrochemical cell according to claim 13, wherein said coupling device is selected from the group consisting of a bus bar, the cell body, the cell lid, and electrochemical cell system piping.

16. The system for detecting a short incident in an electrochemical cell according to claim 13, wherein said means for detecting vibration is selected from the group consisting of an accelerometer, Linear Variable Displacement Transducer, strain gauge, veloci-meter, dial indicator, capacitance gauge, eddy current probe, induction sensor, ultrasonic sensor, fiber optic, and laser interferometer.

17. The system for detecting a short incident in an electrochemical cell according to claim 13, wherein said accelerometer is a piezoelectric accelerometer.

18. The system for detecting a short in an electrochemical cell according to claim 13, wherein said accelerometer detects movement over a frequency range from about 0.5 hertz to about 5000 hertz.

19. The system for detecting a short incident in an electrochemical cell according to claim 13, wherein said means for analyzing and monitoring vibration is selected from the group consisting of a personal computer, data logger, data storage device, DAT tape recorder, oscilloscope, strip chart recorder, data acquisition system, programmable logic controller, and present on-line process monitoring system.

20. The system for detecting a short incident in an electrochemical cell according to claim 19, wherein said personal computer comprises a means for establishing a normal baseline a amplitude envelope.

21. The system for detecting a short incident in an electrochemical cell according to claim 13, wherein said means for measuring and monitoring vibration comprises a personal computer, monitor, signal conditioner and isolator backplane, an analog-to-digital converter data acquisition card, a power supply coupler, and cables.

22. The system for detecting a short incident in an electrochemical cell according to claim 13, wherein said means for analyzing and monitoring vibration is connected to said means for detecting vibration via a coaxial cable.

23. The system for detecting a short incident in an electrochemical cell according to claim 13, wherein the amplitude excursion exceeds the normal baseline amplitude envelope by at least 200%.

24. The system for detecting a short incident in an electrochemical cell according to claim 13, wherein said system further comprises one or more additional means for detecting vibration, said additional means not connected to said coupling device, wherein said additional means identifies vibrations outside of said cell pack.

* * * * *